US009150035B2

(12) United States Patent
Murakami

(10) Patent No.: US 9,150,035 B2
(45) Date of Patent: Oct. 6, 2015

(54) RECORDING APPARATUS

(71) Applicant: Kenji Murakami, Nagoya (JP)

(72) Inventor: Kenji Murakami, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/168,194

(22) Filed: Jan. 30, 2014

(65) Prior Publication Data

US 2014/0210905 A1 Jul. 31, 2014

(30) Foreign Application Priority Data

Jan. 31, 2013 (JP) ..... 2013-016590

(51) Int. Cl.
*B41J 2/165* (2006.01)
*B41J 2/01* (2006.01)
*B41J 11/06* (2006.01)

(52) U.S. Cl.
CPC ..... *B41J 11/06* (2013.01)

(58) Field of Classification Search
CPC ..... B41J 11/0045
USPC ..... 347/29, 101
See application file for complete search history.

(56) References Cited

U.S. PATENT DOCUMENTS 5,648,837 A 7/1997 Tamai
2005/0201765 A1 9/2005 Shinga
2008/0049058 A1 2/2008 Yakura et al.

FOREIGN PATENT DOCUMENTS

JP 2010-155445 7/2010
JP 2010155445 A * 7/2010
JP 2010-208241 9/2010

OTHER PUBLICATIONS

U.S. Appl. No. 14/040,546.
Non-Final Office Action for U.S. Appl. No. 14/040,546 dated Aug. 1, 2014.
Notice of Allowance for U.S. Appl. No. 14/040,546 dated Feb. 4, 2015.

* cited by examiner

*Primary Examiner* — Jason Uhlenhake
(74) *Attorney, Agent, or Firm* — Frommer Lawrence & Haug LLP

(57) ABSTRACT

A support member includes first portions. At least one of upstream and downstream guides includes second portions. The first and second portions are arranged in an orthogonal direction orthogonal to a conveyance direction. Each of the first and second portions extends in the conveyance direction and includes a support surface for supporting the recording medium. At least one of the first portions is positioned between two second portions of the second portions in the orthogonal direction. The two second portions are adjacent to each other in the orthogonal direction. Each of the first portions is at a different position from each of the second portions with respect to the orthogonal direction. Each of the first portions overlaps the second portions with respect to the conveyance direction.

17 Claims, 12 Drawing Sheets

RECORDING APPARATUS

CROSS REFERENCE TO RELATED APPLICATION

This application claims priority from Japanese Patent Application No. 2013-016590, which was filed on Jan. 31, 2013, the disclosure of which is herein incorporated by reference in its entirety.

BACKGROUND OF THE INVENTION

1 Field of the Invention

The present invention relates to a recording apparatus configured to record an image by ejecting liquid onto a recording medium.

2 Description of Related Art

A known recording apparatus includes a support member and a moving mechanism configured to move the support member so as to cause the support member to take an opposing position at which the support member opposes an ejection surface of a head and a retracting position at which the support member does not oppose the ejection surface. The support member is, for example, at the opposing position in recording and at the retracting position in a maintenance operation. The support member may include an upstream support member and a downstream support member both of which are positioned on an upper surface of a frame.

SUMMARY OF THE INVENTION

The upstream end of the upper surface of the frame may constitute an upstream guide which is positioned upstream of the head in the conveyance direction and configured to support a recording medium. If a level difference including a vertical gap is formed between the upstream guide and the upstream end of the upstream support member, the leading end of the recording medium is might be caught at the difference, to cause jamming of the recording medium.

An object of the present invention is to provide a recording apparatus in which jamming of a recording medium is suppressed.

A recording apparatus according to an aspect of the invention comprises a head, a conveyor, a support member, a moving mechanism, an upstream guide, and a downstream guide. The head includes an ejection surface on which a plurality of ejection openings for ejecting liquid are formed. The conveyor is configured to convey a recording medium toward a space which opposes the ejection surface. The support member is configured to support the recording medium in the space. The moving mechanism is configured to move the support member in a conveyance direction in which the recording medium is conveyed by the conveyor to cause the support member to take an opposing position at which the support member opposes the ejection surface and a retracting position at which the support member does not oppose the ejection surface. The upstream guide is positioned upstream of the head in the conveyance direction and configured to support the recording medium. The downstream guide is positioned downstream of the head in the conveyance direction and configured to support the recording medium. The support member includes a plurality of first portions arranged in an orthogonal direction which is orthogonal to the conveyance direction. Each of the first portions extends in the conveyance direction and includes a support surface for supporting the recording medium. At least one of the upstream and downstream guides includes a plurality of second portions arranged in the orthogonal direction. Each of the second portions extends in the conveyance direction and includes a support surface for supporting the recording medium. At least one of the first portions is positioned between two second portions of the second portions. The two second portions are adjacent to each other in the orthogonal direction. Each of the first portions is at a different position from each of the second portions with respect to the orthogonal direction. Each of the first portions overlaps the second portions with respect to the conveyance direction.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
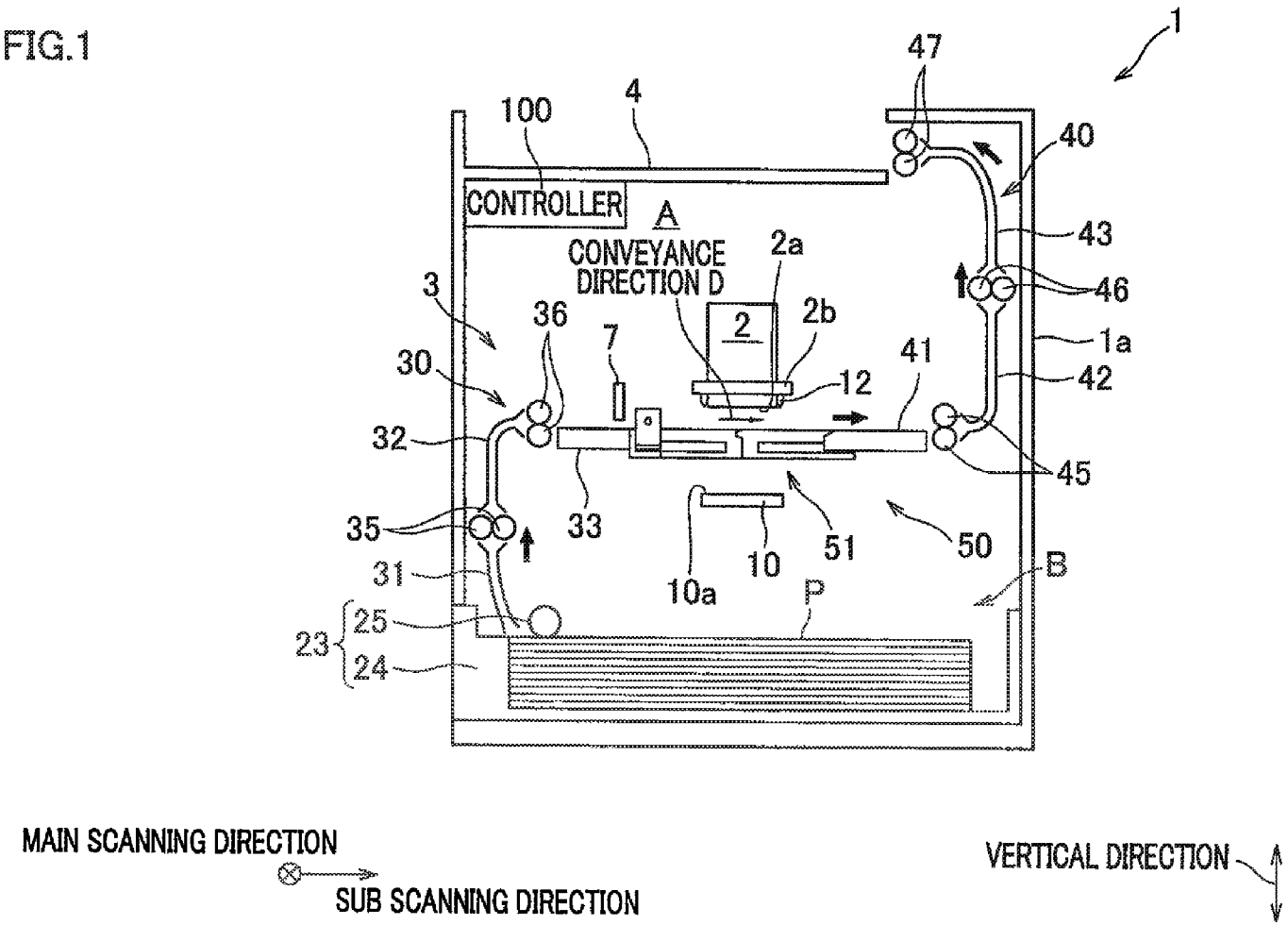
FIG. 1 is a schematic profile showing the internal structure of an inkjet printer of one embodiment of the present invention.

The following will describe a preferred embodiment of the present invention with reference to figures. In the following description, the expressions "front", "rear", "upper", "lower", "right", and "left" are used to define the various parts when a recording apparatus of the present invention is disposed in an orientation in which it is intended to be used.

To begin with, referring to FIG. 1, the overall structure of an inkjet printer 1 of an embodiment of the present invention will be described.

The printer 1 includes a rectangular parallelepiped housing 1*a*. On the top plate of the housing 1*a* is provided a sheet discharge section 4. The internal space of the housing 1*a* is divided into a space A which is the upper space and a space B which is the lower space. In the spaces A and B, a conveying path of sheets P is formed to extend from a sheet feeding section 23 toward the sheet discharge section 4. The sheets P are conveyed along the black thick arrows shown in FIG. 1. In the space A, image formation on each sheet P and conveyance of the sheets P to the sheet discharge section 4 are conducted. In the space B, the sheets P are fed from the sheet feeding section 23 to the conveying path.

In the space A, members such as a head 2, a conveyor unit 3, an opposing member 10, and an opposing member elevation mechanism 11 (see FIG. 8) are provided. In the space A, a cartridge (not illustrated) is attached. This cartridge stores black ink. The cartridge is connected to the head 2 via a tube (not illustrated) and a pump 8 (see FIG. 8). The ink in the cartridge is supplied to the head 2

The head 2 is a line-type head. The head 2 is rectangular parallelepiped in shape and long in a main scanning direction. A lower surface of the head 2 functions as an ejection surface 2*a* on which a plurality of ejection openings (not illustrated) are formed. When recording is carried out, the black ink is ejected through the ejection openings. The head 2 is supported by the housing 1*a* via a holder 2*b*. The holder 2*b* holds the head 2 so that a predetermined gap suitable for the recording is formed between a platen 51 and the ejection surface 2*a*.

The conveyor unit 3 includes an upstream guide unit 30, a downstream guide unit 40, and a support unit 50. The support unit 50 includes the platen 51 and a roller pair 58 (see FIG. 2). Between the platen and the ejection surface 2*a* is formed a recording space. The recording space constitutes the conveying path. The platen 51 is configured to support a sheet P disposed in the recording space, and corresponds to a support member of the present invention. The roller pair 58 is rotated by a conveyance motor 58M (see FIG. 8) under the control of a controller 100, and conveys a sheet P in a conveyance direction D. The roller pair 58 is configured to convey a sheet P to the recording space, and corresponds to a conveyor of the present invention. Hereinafter, "upstream" and "downstream" in the conveyance direction D in which a sheet P is conveyed by the roller pair 58 will be simply referred to as "upstream" and "downstream", respectively.

The guide units 30 and 40 are positioned to sandwich the platen 51. The upstream guide unit 30 includes three guides 31 to 33 and two roller pairs 35 and 36, and connects the recording space with the sheet feeding section 23. The two roller pairs 35 and 36 are rotated by conveyance motors 35M and 36M (see FIG. 8) under the control of the controller 100 so as to convey the sheets P toward the recording space.

The downstream guide unit 40 includes three guides 41 to 43 and three roller pairs 45 to 47, and connects the recording space with the sheet discharge section 4. The three roller pairs 45 to 47 are rotated by conveyance motors 45M to 47M (see FIG. 8) under the control of the controller 100 so as to convey the sheets P toward the sheet discharge section 4. The conveying path is defined by the six guides 31 to 33 and 41 to 43, the platen 51, and the bead 2.

As shown in FIG. 1, the opposing member 10 is positioned below the platen 51 and opposes the ejection surface 2*a* over the platen 51. The opposing member 10 is formed by a rectangular glass plate and is a size larger than the ejection surface 2*a* when viewed in the vertical direction (see FIG. 6). The opposing member 10 may be made of any material other than glass.

Figure 9A:
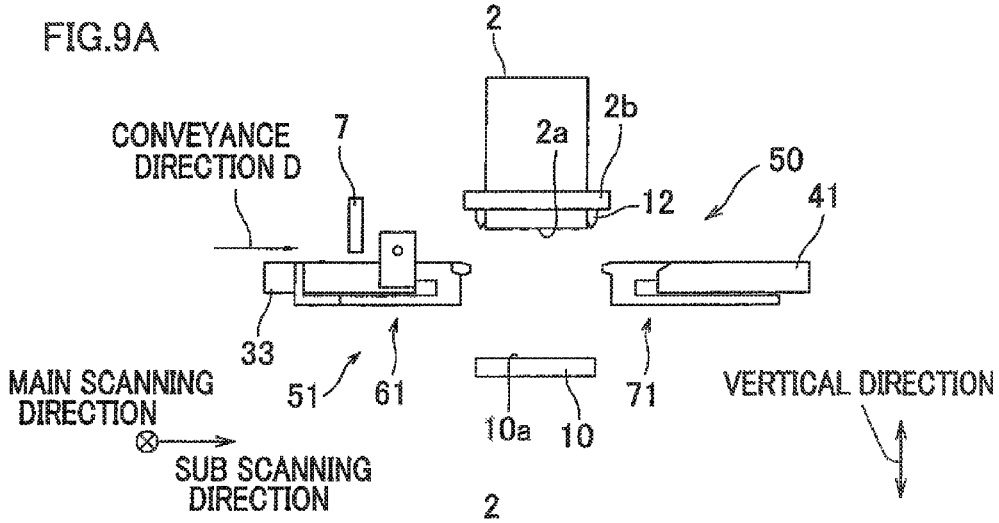
FIG. 9A is a partial profile of the printer when the platen is at the retracting position and an opposing member is at a waiting position.
Figure 9B:
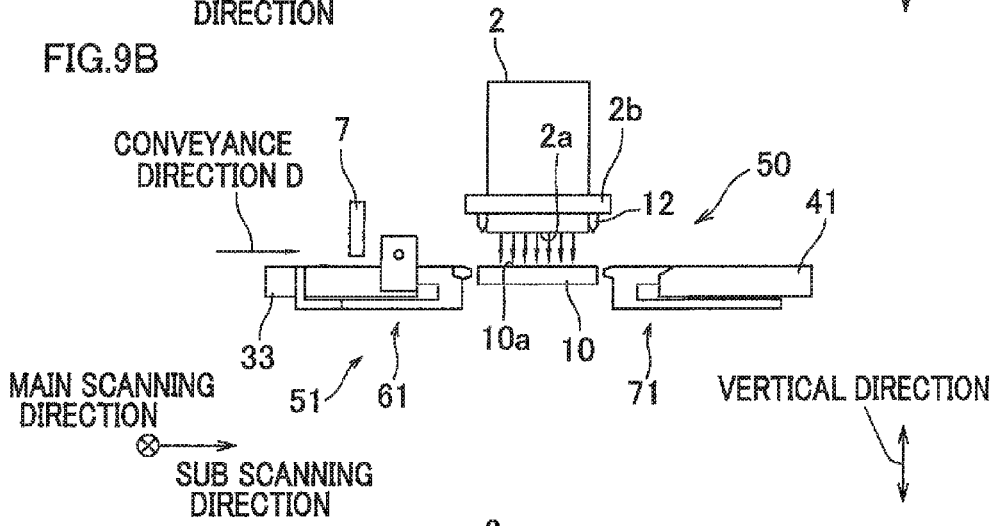
FIG. 9B is a partial profile of the printer when the platen is at the retracting position and the opposing member is at an ink receiving position.
Figure 9C:
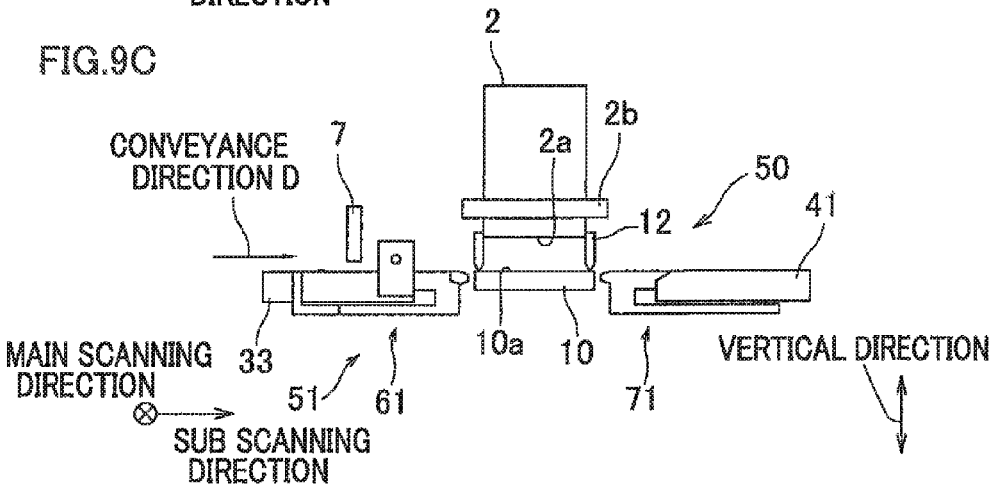
FIG. 9C is a partial profile of the printer when the platen is at the retracting position and an annular member is in contact with the opposing member which is at the ink receiving position.

The opposing member elevation mechanism 11 is configured to vertically move the opposing member 10. The opposing member 10 therefore takes a waiting position and an ink receiving position. The waiting position which is shown in FIGS. 1 and 9A is a position at which the opposing member 10 is most distant from the ejection surface 2*a*. The ink receiving position which is shown in FIG. 9B is a position at which the opposing member 10 is closest to the ejection surface 2*a*. When the opposing member 10 is at the ink receiving position, the opposing member 10 receives the ink discharged from the ejection openings. The opposing member 10 corresponds to a receiver of the present invention. The opposing member 10 is also at the ink receiving position when the surface 10*a* of the opposing member 10 is wiped and when the capping is conducted. An annular member 12 is positioned to entirely surround the periphery of the ejection surface 2*a*. An annular member elevation mechanism 13 is configured to vertically move the annular member 12. The annular member 12 therefore takes a position (shown in FIG. 9C) where the annular member 12 is in contact with the opposing member 10 at the ink receiving position and a position (shown in FIG. 9A) where the annular member 12 is not in contact with the opposing member 10. The opposing member 10, the opposing member elevation mechanism 11, the annular member 12, and the annular member elevation mechanism 13 constitute a maintenance unit of the present invention. The maintenance unit is configured to conduct a maintenance operation to recover and maintain the capability of the ink ejection from the ejection openings.

In the space B is provided the sheet feeding section 23. The sheet feeding section 23 includes a sheet feeding tray 24 and a pickup roller 25. The sheet feeding tray 24 is configured to be detachable from the housing 1*a*. The sheet feeding tray 24 is an open-top box capable of storing the sheets P. The pickup roller 25 is rotated by a pickup motor 25M (see FIG. 8) under the control of the controller 100, and sends out the topmost sheet P in the sheet feeding tray 24.

A sub-scanning direction is in parallel to the conveyance direction D. The main scanning direction is in parallel to the horizontal plane and orthogonal to the sub-scanning direction. The vertical direction is orthogonal to the main scanning direction, the sub-scanning direction, and the ejection surface 2*a*. The main scanning direction corresponds to an orthogonal direction of the present invention.

The controller 100 manages the overall operation of the printer 1 by controlling the operation of each part of the printer 1. The controller 100 controls a recording operation based on a recording command input from an external apparatus (e.g., a PC connected to the printer 1). More specifically, upon receiving the recording command, the controller 100 drives the pickup roller 25 and the roller pairs 35, 36, 45 to 47, and 58. A sheet P sent out from the sheet feeding tray 24 is guided by the upstream guide unit 30 to the surface of the platen 51. When the sheet P passes through the position immediately below the head 2 in the conveyance direction D, ink is ejected from the ejection openings under the control of the controller 100, with the result that a desired image is formed on the sheet P. The timing to eject the ink from the ejection openings is determined based on a detection signal sent from a sheet sensor 7. The sheet P on which the image has been formed is guided by the downstream guide unit 40 and discharged to the sheet discharge section 4 from an upper part of the housing 1*a*. The sheet sensor 7 is positioned between the roller pair 36 and the head 2 in the conveyance direction D.

The controller 100 controls the maintenance operation. The maintenance operation includes purging, wiping, and capping. The purging is an operation to forcibly discharge ink to the opposing member 10 from all the ejection openings by means of the pressure supplied to the ejection openings from the pump 8. The wiping is an operation conducted on the ejection surface 2*a* and the surface 10*a* after the purging, to remove foreign matters such as ink remaining on the surfaces. The capping is an operation to close the recording space and separate the recording space from the external space by bringing the annular member 12 into contact with the opposing member 10 which is at the ink receiving position. The opposing member 10 and the annular member 12 constitute a cap of the present invention.

Figure 2:
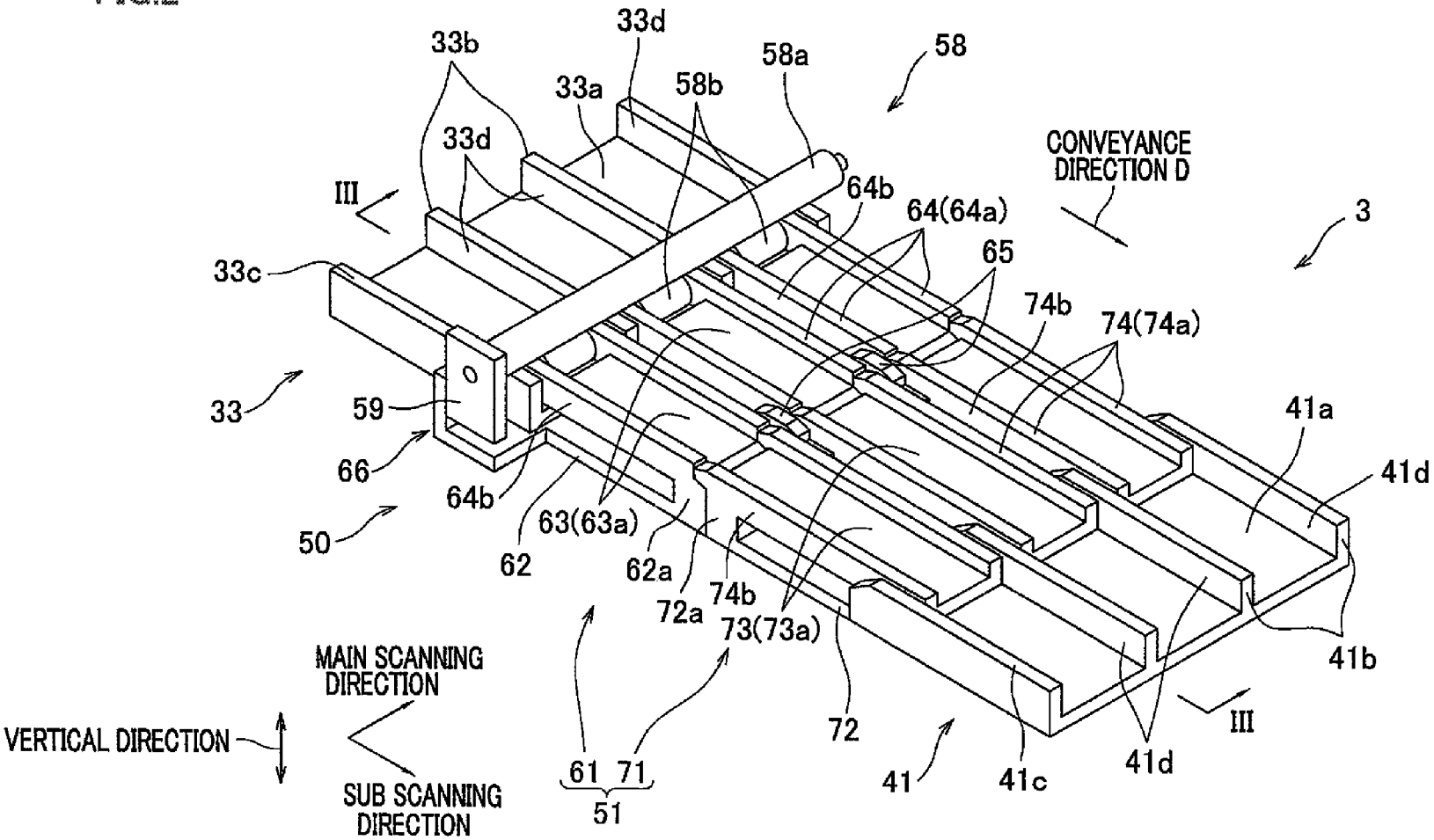
FIG. 2 is a partial oblique perspective view of a conveyor unit, when a platen is at an opposing position.
Figure 3:
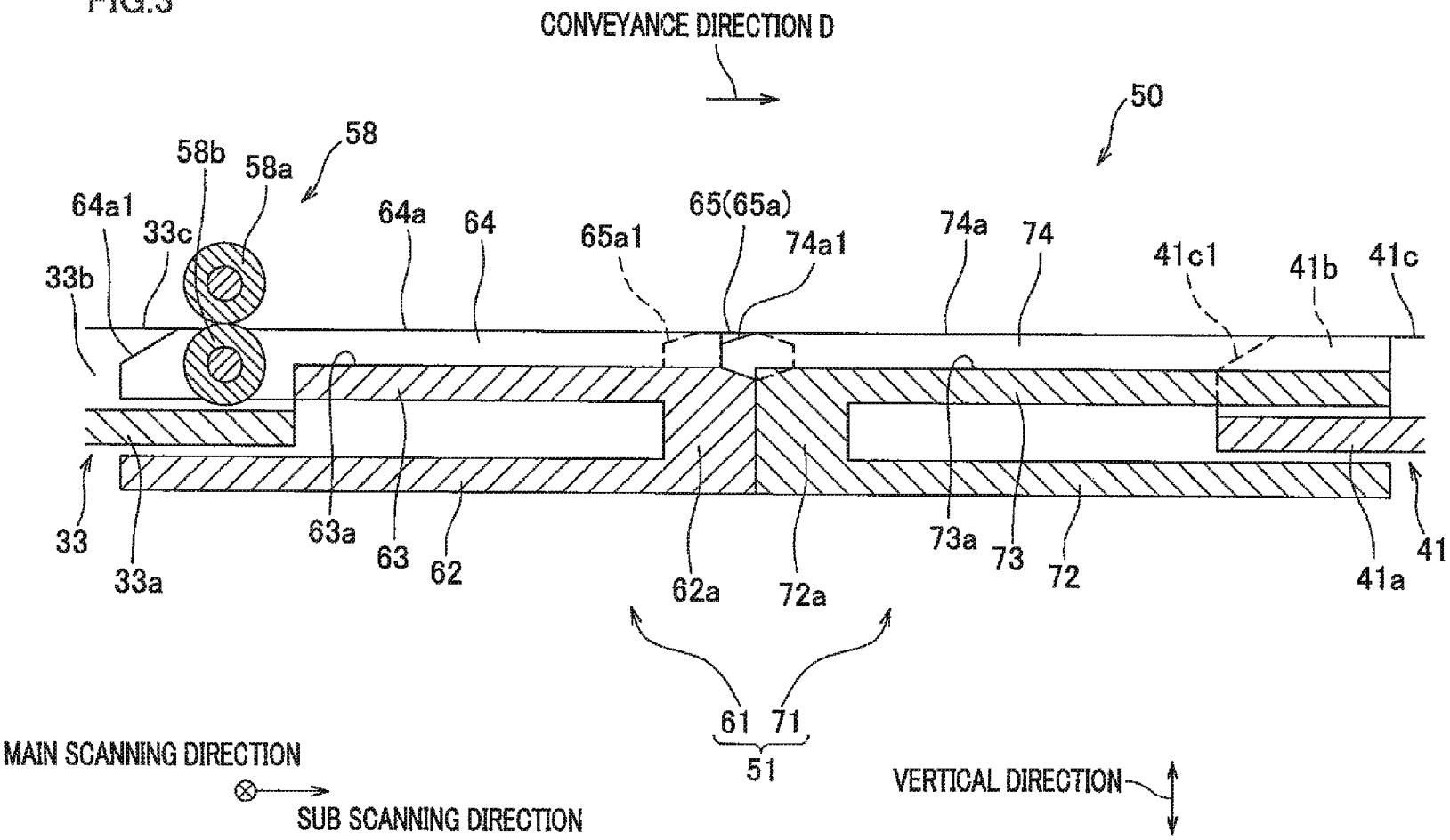
FIG. 3 is a partial cross section taken along a line III-III shown in FIG. 2.

Now, referring to FIGS. 2 to 7, the guides 33 and 41, and the platen 51 will be described in detail. The guide 33 is positioned upstream of the head 2 and configured to support a sheet P. The guide 33 corresponds to an upstream guide of the present invention. The guide 41 is positioned downstream of the head 2 and configured to support a sheet P. The guide 41 corresponds to a downstream guide of the present invention. As shown in FIGS. 2 and 3, the platen 51 includes an upstream support member 61 and a downstream support member 71. The downstream support member 71 is positioned downstream of the upstream support member 61.

Figure 4:
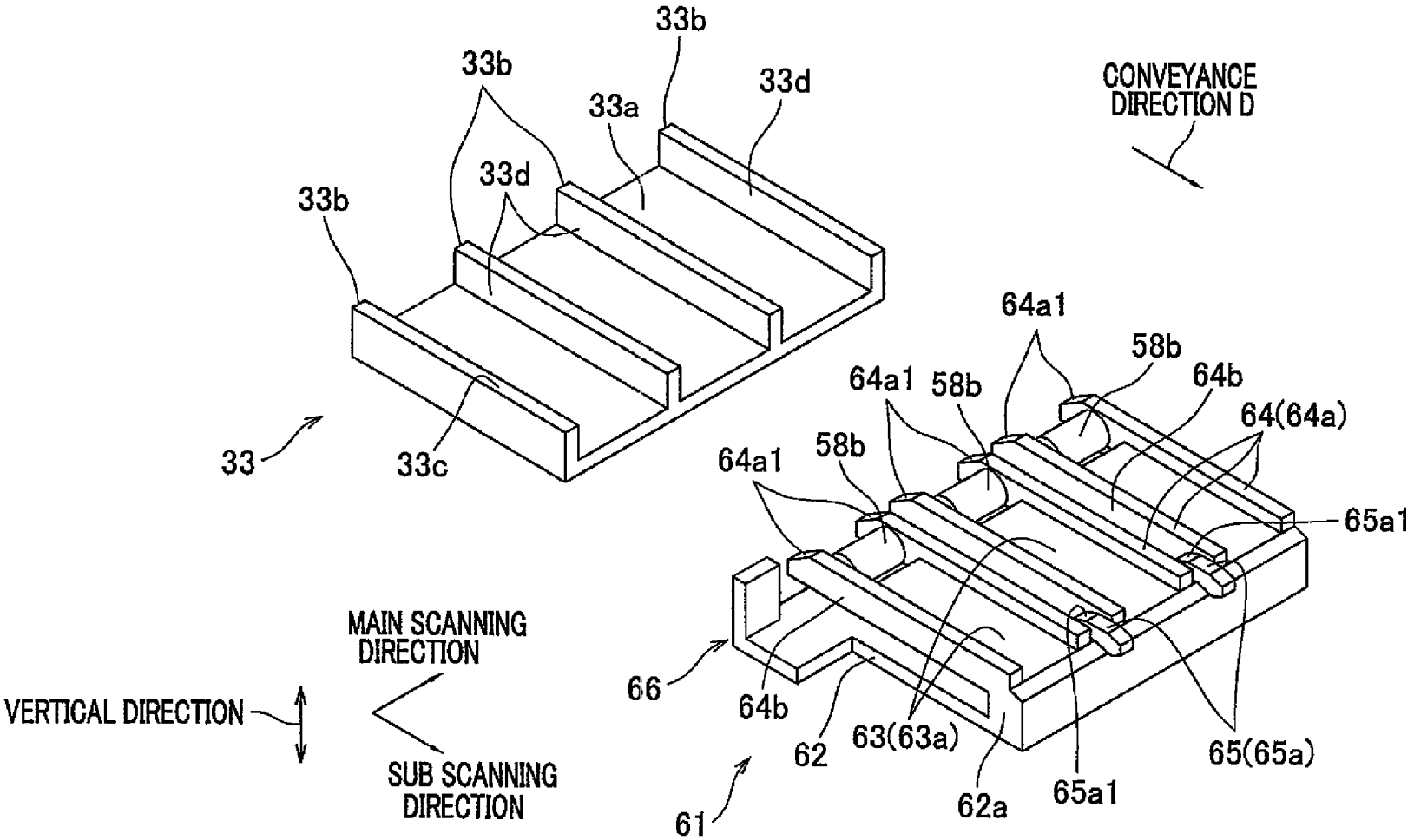
FIG. 4 is an exploded oblique perspective view of an upstream guide and an upstream support member.

As shown in FIG. 4, the upstream support member 61 includes: a base 62 formed by a plate having a rectangular shape in plan view; three plates 63 each extending in the conveyance direction D; and six ribs 64 each extending in the conveyance direction D. The base 62, the three plates 63, and the six ribs 64 are integrally formed. At the downstream end of the base 62, a connector 62*a* is formed. The connector 62*a* protrudes upward from an upper surface of the base 62, and extends in the main scanning direction. The three plates 63 are connected to the base 62 via the connector 62*a*. The three plates 63 are positioned above the base 62 while being spaced apart from the base 62. The three plates 63 are arranged in the main scanning direction apart from one another at regular intervals. Upper surfaces 63*a* of the three plates 63 are positioned on the same level as one another.

The ribs 64 correspond to first portions and upstream first portions of the present invention. The ribs 64 protrude upward at both ends of the plates 63 in the main scanning direction. The downstream end of each rib 64 is connected to the connector 62*a*. The ribs 64 extend further toward an upstream direction than the plates 63. The six ribs 64 are spaced apart from one another and arranged in the main scanning direction. With respect to the main scanning direction, the distance between two ribs 64 which are adjacent to each other without the plate 63 interposed therebetween is smaller than the distance between two ribs 64 which are adjacent to each other with the plate 63 interposed therebetween. An upper surface 64*a* of each rib 64 corresponds to a support surface of the present invention, and it is a surface for supporting a sheet P. The upper surfaces 64*a* are positioned higher than the upper surfaces 63*a*. As shown in FIGS. 3 and 4, each rib 64 has a slope 64*a*1. The slope 64*a*1 corresponds to a first slope of the present invention. The slope 64*a*1 is inclined upward from the upstream end of the rib 64 toward a downstream direction. Therefore, the upstream ends of the ribs 64 are positioned lower than the upper surfaces 64*a*.

The upstream support member 61 includes two ribs 65 each having a shorter length in the sub scanning direction than that of each rib 64. The ribs 65 correspond to third portions of the present invention. The ribs 65 are fixed to the upper end of the connector 62*a*. Each rib 65 is positioned between corresponding two ribs 64 which are adjacent to each other in the main scanning direction without the plate 63*a* interposed therebetween. The ribs 65 extend further toward the downstream direction than the ribs 64. Upper surfaces 65*a* of the ribs 65 are positioned on the same level as the upper surfaces 64*a*. As shown in FIGS. 3 and 4, each rib 65 has a slope 65*a*1. The slope 65*a*1 is inclined upward from the upstream end of the rib 65 toward the downstream direction. Therefore, the upstream ends of the ribs 65 are positioned lower than the upper surfaces 64*a* and 65*a*.

A contact portion 66 is formed at a corner of the upstream end of the base 62 and one end of the base 62 in the main scanning direction, that is, the end of the base 62 closer to a viewer in FIG. 4. The contact portion 66 has an L-shape cross section. As shown in FIG. 2, the roller pair 58 includes one roller 58*a* and three rollers 58*b*. The roller 58*a* corresponds to a second roller of the present invention, and the rollers 58*b* correspond to a first roller of the present invention. Each of the rollers 58*a* and 58*b* extends in the main scanning direction. One end of the roller 58*a* in the main scanning direction is rotatably supported by a flange 59, while the other end of the roller 58*a* in the main scanning direction is rotatably supported by the housing 1*a*. The flange 59 is fixed to the housing 1*a*. The roller 58*a* is a driving roller which is rotated by the power from the conveyance motor 58M. The roller 58*a* rotates while gripping a sheet P in cooperation with the three rollers 58*b*, and thereby conveys the sheet P in the conveyance direction D. Each roller 58*b* has a shorter length in the main scanning direction than that of the roller 58*a*. Each roller 58*b* is positioned upstream of the corresponding plate 63, and between two ribs 64 which are formed on the plate 63 and are adjacent to each other in the main scanning direction. Each roller 58*b* is attached to the two ribs 64, and is rotatably supported by the two ribs 64. The three rollers 58*b* are driven rollers which is rotated by rotation of the roller 58*a*. The ribs 64 have a function of supporting a sheet P, and a function of supporting the rollers 58*b*.

Figure 5:
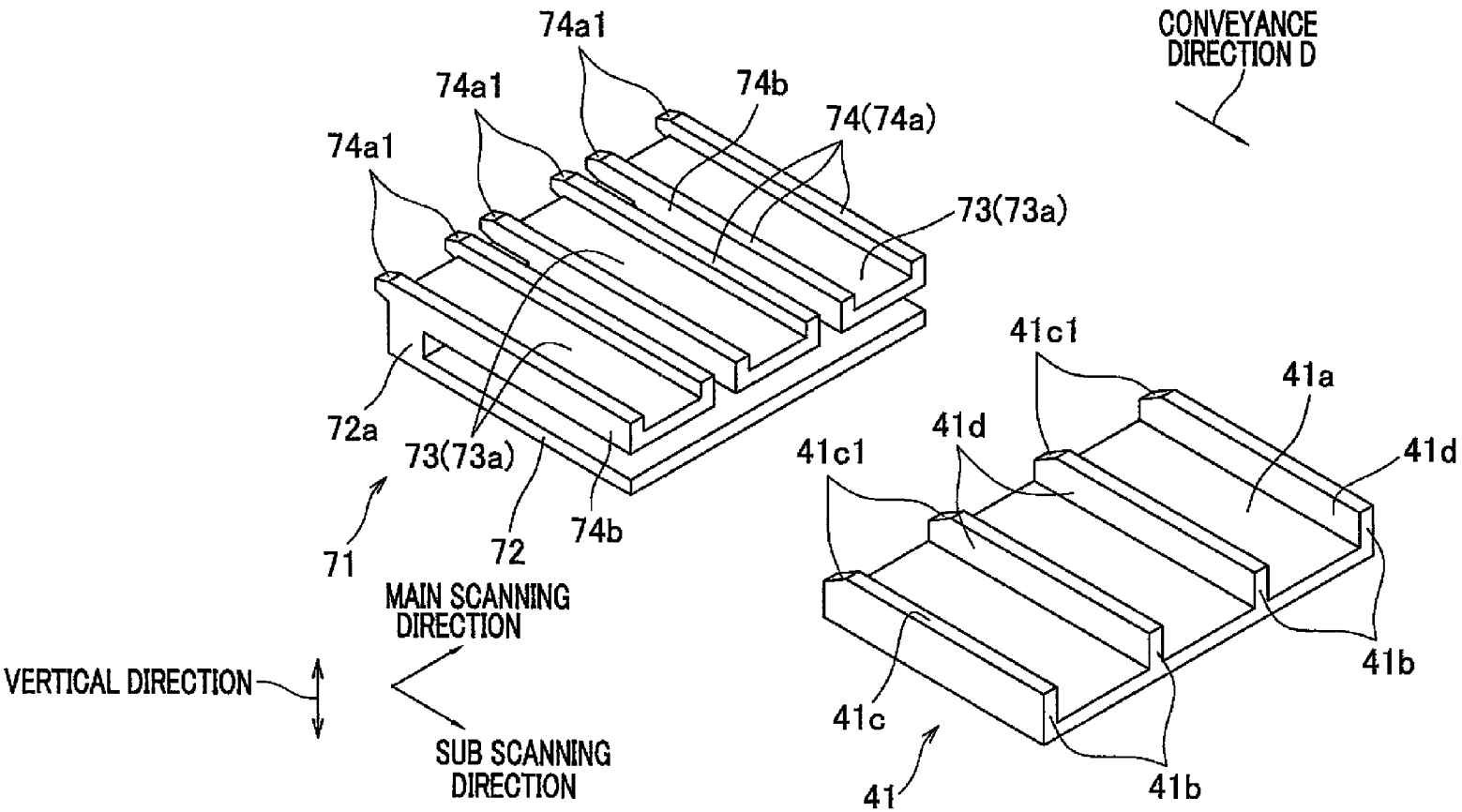
FIG. 5 is an exploded oblique perspective view of a downstream guide and a downstream support member.

As shown in FIG. 5, the downstream support member 71 includes: a base 72 formed by a plate having a rectangular shape in plan view, three plates 73 each extending in the conveyance direction D, and six ribs 74 each extending in the conveyance direction D. The base 72, the three plates 73, and the six ribs 74 are integrally formed. At the upstream end of the base 72, a connector 72*a* is formed. The connector 72*a* protrudes upward from an upper surface of the base 72, and extends in the main scanning direction. The three plates 73 are connected to the base 72 via the connector 72*a*. The three plates 73 are positioned above the base 72 while being spaced apart from the base 72. The three plates 73 are arranged in the main scanning direction apart from one another at regular intervals. Upper surfaces 73*a* of the three plates 73 are positioned on the same level as one another.

The ribs 74 correspond to the first portions and downstream first portions of the present invention. The ribs 74 protrude upward at both ends of the plates 73 in the main scanning direction. The upstream end of each rib 74 is connected to the connector 72*a*. The ribs 74 extend further toward the upstream direction than the connector 72*a*. The six ribs 74 are spaced apart from one another and arranged in the main scanning direction. With respect to the main scanning direction, the distance between two ribs 74 which are adjacent to each other without the plate 73 interposed therebetween is smaller than the distance between two ribs 74 which are adjacent to each other with the plate 73 interposed therebetween. An upper surface 74*a* of each rib 74 corresponds to the support surface of the present invention, and it is the surface for supporting a sheet P. The upper surfaces 74*a* are positioned higher than the upper surfaces 73*a*. The ribs 74 are at the same positions as the ribs 64, respectively, with respect to the main scanning direction. That is, as shown in FIG. 2, each pair of ribs 64 and 74 are buttable against each other in the conveyance direction D. The upper surfaces 74*a* are positioned on the same level as the upper surfaces 64*a* and 65*a*. As shown in FIGS. 3 and 5, each rib 74 has a slope 74*a*1. The slope 74*a*1 is inclined upward from the upstream end of the rib 74 toward the downstream direction. Therefore, the upstream ends of the ribs 74 are positioned lower than the upper surfaces 74*a*. That is, the upstream ends of the ribs 74 are positioned on the same level as the upper surfaces 64*a* and 65*a*, or lower than the upper surfaces 64*a* and 65*a*.

Figure 6:
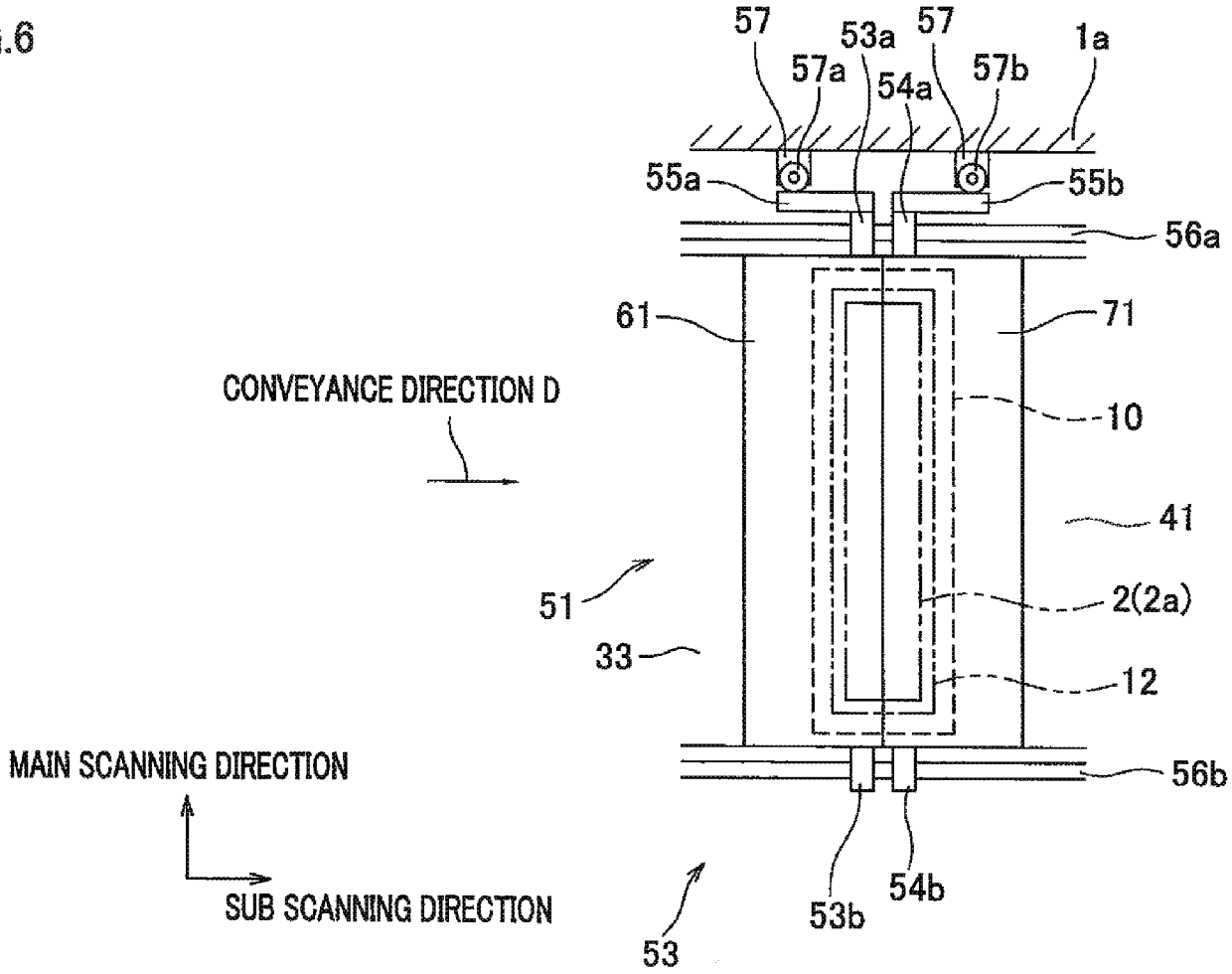
FIG. 6 is a plan view of the platen and a moving mechanism.

The platen 51 is configured to be moved by a moving mechanism 53 shown in FIG. 6. The moving mechanism 53 includes two protrusions 53*a* and 53*b* protruding from the respective side faces of the upstream support member 61, two protrusions 54*a* and 54*b* protruding from the respective side faces of the downstream support member 71, two racks 55*a* and 55*b*, two guide shafts 56*a* and 56*b*, and two drive motors 57. The overall structure of the moving mechanism 53 is illustrated only in FIG. 6 for convenience of explanation.

At the center of each of the protrusions 53*a*, 53*b*, 54*a*, and 54*b*, a through hole is formed to extend in the conveyance direction D. The guide shafts 56*a* and 56*b* extend in the conveyance direction D to sandwich the platen 51 in the main scanning direction. The guide shaft 56*a* is inserted into the through holes of the protrusions 53*a* and 54*a*. The guide shaft 56*b* is inserted into the through holes of the protrusions 53*b* and 54*b*. The guide shafts 56*a* and 56*b* support the upstream support member 61 and the downstream support member 71 to be movable in the conveyance direction D. To the leading end of the drive shaft of each drive motor 57, a pinion 57*a*, 57*b* is fixed. The rack 55*a* is fixed to the protrusion 53*a* while being engaged with the pinion 57*a*. The rack 55*b* is fixed to the protrusion 54*a* while being engaged with the pinion 57*b*.

Figure 7:
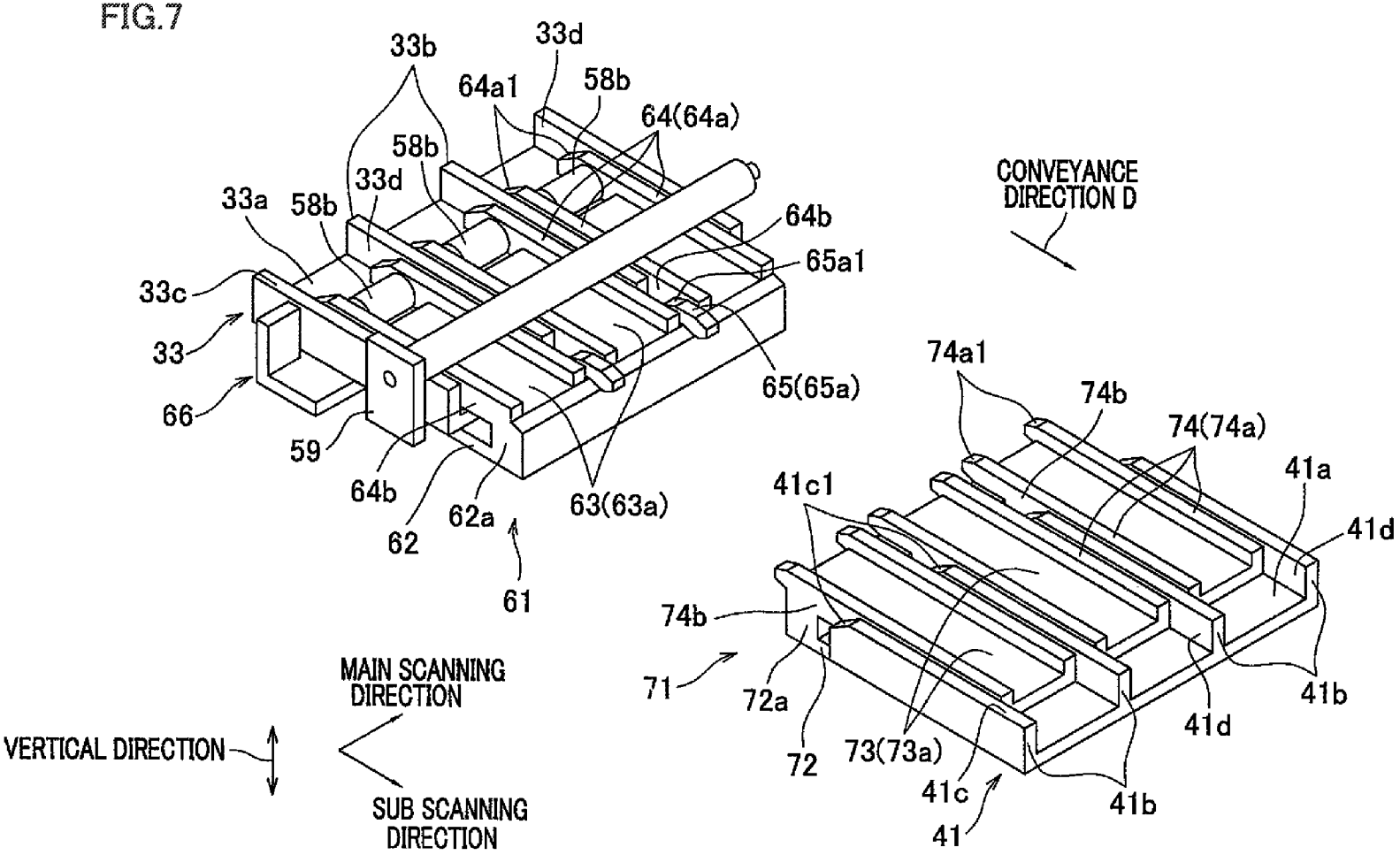
FIG. 7 is a partial oblique perspective view of the conveyor unit, when the platen is at a retracting position.

As the two drive motors 57 are driven under the control of the controller 100, the two racks 55*a* and 55*b* are moved in opposite directions along the conveyance direction D. That is to say, the moving mechanism 53 moves the upstream support member 61 and the downstream support member 71 in the opposite directions along the conveyance direction D so that the platen 51 takes the opposing position at which the platen 51 opposes the ejection surface 2*a* and the retracting position at which the platen 51 does not oppose the ejection surface 2*a*. Specifically, as shown in FIG. 7, when the platen 51 moves from the opposing position to the retracting position, the upstream support member 61 moves toward the upstream direction whereas the downstream support member 71 moves toward the downstream direction. More specifically, the upstream support member 61 moves toward the upstream direction when moving from a first opposing position at which the upstream support member 61 opposes the ejection surface 2*a* to a first retracting position at which the upstream support member 61 does not oppose the ejection surface 2*a*, the first retracting position being upstream of the ejection surface 2*a*. The downstream support member 71 moves toward the downstream direction when moving from a second opposing position at which the downstream support member 71 opposes the ejection surface 2*a* to a second retracting position at which the downstream support member 71 does not oppose the ejection surface 2*a*, the second retracting position being downstream of the ejection surface 2*a*. When the platen 51 moves from the retracting position to the opposing position, the upstream support member 61 and the downstream support member 71 move in the opposite manner.

When the platen 51 is at the opposing position, that is, when the upstream support member 61 is at the first opposing position and the downstream support member 71 is at the second opposing position, the opposing ends of the upstream support member 61 and the downstream support member 71 butt against each other (see FIGS. 2 and 3). At this time, each pair of ribs 64 and 74 butt against each other in close proximity with each other in the conveyance direction D, and the ribs 65 overlap the upstream ends of the ribs 74 with respect to the conveyance direction D. Specifically, each rib 65 is positioned between corresponding two ribs 74 adjacent to each other in the main scanning direction and between corresponding two ribs 64 adjacent to each other in the main scanning direction, and the ribs 65 overlap the ribs 64 and 74 with respect to the conveyance direction D. At this time, the upper surfaces 64*a*, 65*a*, and 74*a* are positioned on the same level as one another, and the upper surfaces 64*a*, 65*a*, and 74*a* support a sheet P. Meanwhile, the upstream ends of the ribs 74 are positioned on the same level as the upper surfaces 65*a* or lower than the upper surfaces 65*a*. Therefore, a projecting level difference, i.e., an upheaval formed by a higher-positioned downstream member in the conveyance direction D, at which the leading end of a sheet P might be caught is hardly formed between the upstream support member 61 and the downstream support member 71. As a result, jamming of a sheet P is suppressed.

When the platen 51 is at the retracting position, that is, when the upstream support member 61 is at the first retracting position and the downstream support member 71 is at the second retracting position, the opposing ends of the upstream support member 61 and the downstream support member 71 are spaced apart from each other, which allows the opposing member 10 to be positioned between the upstream support member 61 and the downstream support member 71 (see FIGS. 7 and 9). At this time, each pair of ribs 64 and 74 are spaced apart from each other in the conveyance direction D. In this state, the ejection surface 2*a* does not oppose the platen 51 but directly opposes the opposing member 10 over the space. The opposing member 10 is vertically movable. The upstream support member 61 and the downstream support member 71 are normally at the opposing positions, and are at the retracting positions when the maintenance operation is conducted.

When the platen 51 is at the opposing position, the three rollers 58*b* are at a first position at which the rollers 58*b* oppose the roller 58*a* and at which the rollers 58*b* is configured to grip a sheet P in cooperation with the roller 58*a*. When the platen 51 is at the retracting position, the three rollers 58*b* are at a second position at which the three rollers 58*b* are farther away from the roller 58*a* than at the first position. Thus, the distance between the roller 58*a* and the rollers 58*b* is larger when the platen 51 is at the retracting position. This facilitates removing a sheet P jamming between the rollers 58*a* and 58*b*. When the platen 51 is at the opposing position, the contact portion 66 is in contact with the flange 59 corresponding to a roller supporting member of the present invention. This facilitates reliable positioning of the three rollers 58*b* relative to the roller 58*a*.

As shown in FIG. 4, an upstream guide 33 includes a base 33*a* formed by a plate having a rectangular shape in plan view, and four ribs 33*b* each extending in the conveyance direction D. The four ribs 33*b* are formed on an upper surface of the base 33*a*. The upstream guide 33 is fixed to the housing 1*a*. As shown in FIG. 3, the base 33*a* is positioned higher than the base 62, and lower than the plates 63 and the ribs 64. That is, the base 33*a* is able to enter into/exit from a gap created between the base 62 and the plates 63, and does not contact the upstream support member 61 when the upstream support member 61 moves from the first opposing position to the first retracting position.

The ribs 33*b* correspond to second portions and upstream second portions of the present invention. As shown in FIGS. 2 and 7, whichever the platen 51 takes the opposing position and the retracting position, each of the ribs 64 is at a different position from each of the ribs 33*b* with respect to the main scanning direction, and further, each of the ribs 64 overlaps the ribs 33*b* with respect to the conveyance direction D. As shown in FIG. 4, the ribs 33*b* are arranged in the main scanning direction apart from one another at regular intervals. The distance between two ribs 33*b* adjacent to each other in the main scanning direction is larger than the distance between two ribs 64 formed on a single plate 63.

Among the four ribs 33*b*, each of two ribs 33*b* sandwiched between the remaining ribs 33*b* in the main scanning direction is positioned between corresponding two ribs 64 which are adjacent to each other in the main scanning direction without the plate 63 interposed therebetween. Each set of two ribs 64 which are adjacent to each other in the main scanning direction with the plate 63 interposed therebetween is positioned between corresponding two ribs 33*b* adjacent to each other in the main scanning direction. The above-mentioned sandwiched two ribs 33*b* are respectively at the same positions as the two ribs 65 with respect to the main scanning direction.

With respect to the main scanning direction, the distance between one rib 64 and one rib 33*b* adjacent to each other is smaller than the half of the distance between two ribs 33*b* adjacent to each other. Therefore, each rib 64 is positioned, with respect to the main scanning direction, between (i) the midway between the corresponding two ribs 33*b* adjacent to each other and (ii) one of the two ribs 33*b*.

Each rib 64 includes a side face 64*b* along the conveyance direction D. Each rib 33*b* includes a side face 33*d* along the conveyance direction D. The side face 64*b* corresponds to a first side face of the present invention, while the side face 33*d* corresponds to a second side face of the present invention. The side faces 64*b* and 33*d* are positioned so that each side face 64*b* opposes, in the main scanning direction, and contacts the corresponding side face 33*d*. When the upstream support member 61 moves between the first opposing position and the first retracting position, each rib 64 moves relative to the corresponding rib 33*b* with their side faces 64*b* and 33*d* being in contact with each other. This eliminates the necessity of providing a high-accuracy guide mechanism to the moving mechanism 53, which mechanism is configured to prevent the upstream support member 61 from moving in the main scanning direction when the upstream support member 61 is moved in the sub scanning direction. This simplifies the structure of the moving mechanism 53.

The two ribs 65 are respectively at the same positions, with respect to the main scanning direction, as the above-mentioned sandwiched two ribs 33*b*. When the platen 51 is at the opposing position, not only the side faces 64*b* are respectively in contact with the side faces 33*d*, but also the side faces of the ribs 65 are respectively in contact with the corresponding side faces 64*b*. This facilitates positioning of the upstream support member 61 and the downstream support member 71 in the main scanning direction.

An upper surface 33*c* of each rib 33*b* corresponds to the support surface of the present invention, and it is the surface for supporting a sheet P. The upper surfaces 33*c* are positioned on the same level as the upper surfaces 64*a*. The upstream ends of the ribs 64 respectively include the slopes 64*a*1, and therefore the upstream ends of the ribs 64 are positioned on the same level as the upper surfaces 33*c* or lower than the upper surfaces 33*c*. Accordingly, as shown in FIG. 3, a projecting level difference at which the leading end of a sheet P might be caught is hardly fanned between the upstream guide 33 and the upstream support member 61. As a result, jamming of a sheet P is suppressed when the sheet P is conveyed while being supported on the upper surfaces 33*c*.

As shown in FIG. 5, the downstream guide 41 has the substantially same structure as that of the upstream guide 33. Specifically, the downstream guide 41 includes a base 41*a* formed by a plate having a rectangular shape in plan view, and four ribs 41*b* each extending in the conveyance direction D. The four ribs 41*b* are formed on an upper surface of the base 41*a*. The downstream guide 41 is fixed to the housing 1*a*. As shown in FIG. 3, the base 41*a* is positioned higher than the base 72, and lower than the plates 73 and the ribs 74. That is, the base 41*a* is able to enter into/exit from a gap created between the base 72 and the plates 73, and the base 41*a* does not contact the downstream support member 71 when the downstream support member 71 moves from the second opposing position to the second retracting position.

The ribs 41*b* correspond to the second portions and downstream second portions of the present invention. As shown in FIGS. 2 and 7, whichever the platen 51 takes the opposing position and the retracting position, each of the ribs 74 is at a different position front each of the ribs 41*b* with respect to the main scanning direction, and further, each of the ribs 74 overlaps the ribs 41*b* with respect to the conveyance direction D. As shown in FIG. 5, the ribs 41*b* are arranged in the main scanning direction apart from one another at regular intervals. The ribs 41*b* are respectively at the same positions as the ribs 33*b* with respect to the main scanning direction.

Among the four ribs 41*b*, each of two ribs 41*b* sandwiched between the remaining ribs 41*h* in the main scanning direction is positioned between corresponding two ribs 74 which are adjacent to each other in the main scanning direction without the plate 73 interposed therebetween. Each set of two ribs 74 which are adjacent to each other in the main scanning direction with the plate 73 interposed therebetween is positioned between corresponding two ribs 41*b* adjacent to each other in the main scanning direction. The above-mentioned sandwiched two ribs 41*b* are respectively at the same positions as the two ribs 65 with respect to the main scanning direction.

With respect to the main scanning direction, the distance between one rib 41*b* and one rib 74 adjacent to each other is smaller than the half of the distance between two ribs 41*b* adjacent to each other. Therefore, each rib 74 is positioned, with respect to the main scanning direction, between (i) the midway between the corresponding two ribs 41*b* adjacent to each other and (ii) one of the two ribs 41*b*.

Each rib 74 includes a side face 74*b* along the conveyance direction D. Each rib 41*b* includes a side face 41*d* along the conveyance direction D. The side face 74*b* corresponds to the first side face of the present invention, while the side face 41*d* corresponds to the second side face of the present invention. The side faces 74*b* and 41*d* are positioned so that each side face 74*b* opposes, in the main scanning direction, and contacts the corresponding side face 41*d*. When the downstream support member 71 moves between the second opposing position and the second retracting position, each rib 74 moves relative to the corresponding rib 41*b* with their side faces 74*b* and 41*d* being in contact with each other. This eliminates the necessity of providing a high-accuracy guide mechanism to the moving mechanism 53, which mechanism is configured to prevent the downstream support member 71 from moving in the main scanning direction when the downstream support member 71 is moved in the sub scanning direction. This simplifies the structure of the moving mechanism 53.

An upper surface 41*c* of each rib 41*b* corresponds to the support surface of the present invention, and it is the surface for supporting a sheet P. The upper surfaces 41*c* are positioned on the same level as the upper surfaces 74*a*. As shown in FIGS. 3 and 5, each rib 41*b* has a slope 41*c*1. The slope

41*c*1 corresponds to a second slope of the present invention. The slope 41*c*1 is inclined upward from the upstream end of the rib 41*b* toward the downstream direction. Therefore, the upstream ends of the ribs 41*b* are positioned lower than the upper surfaces 41*c*. That is, since the upstream ends of the ribs 41*b* respectively include the slopes 41*c*1, the upstream ends of the ribs 41*b* are positioned on the same level as the upper surfaces 74*a* or lower than the upper surfaces 74*a*. Accordingly, as shown in FIG. 3, a projecting level difference at which the leading end of a sheet P might be caught is hardly formed between the downstream support member 71 and the downstream guide 41. As a result, jamming of a sheet P is suppressed when the sheet P is conveyed while being supported on the upper surfaces 74*a*.

Figure 8:
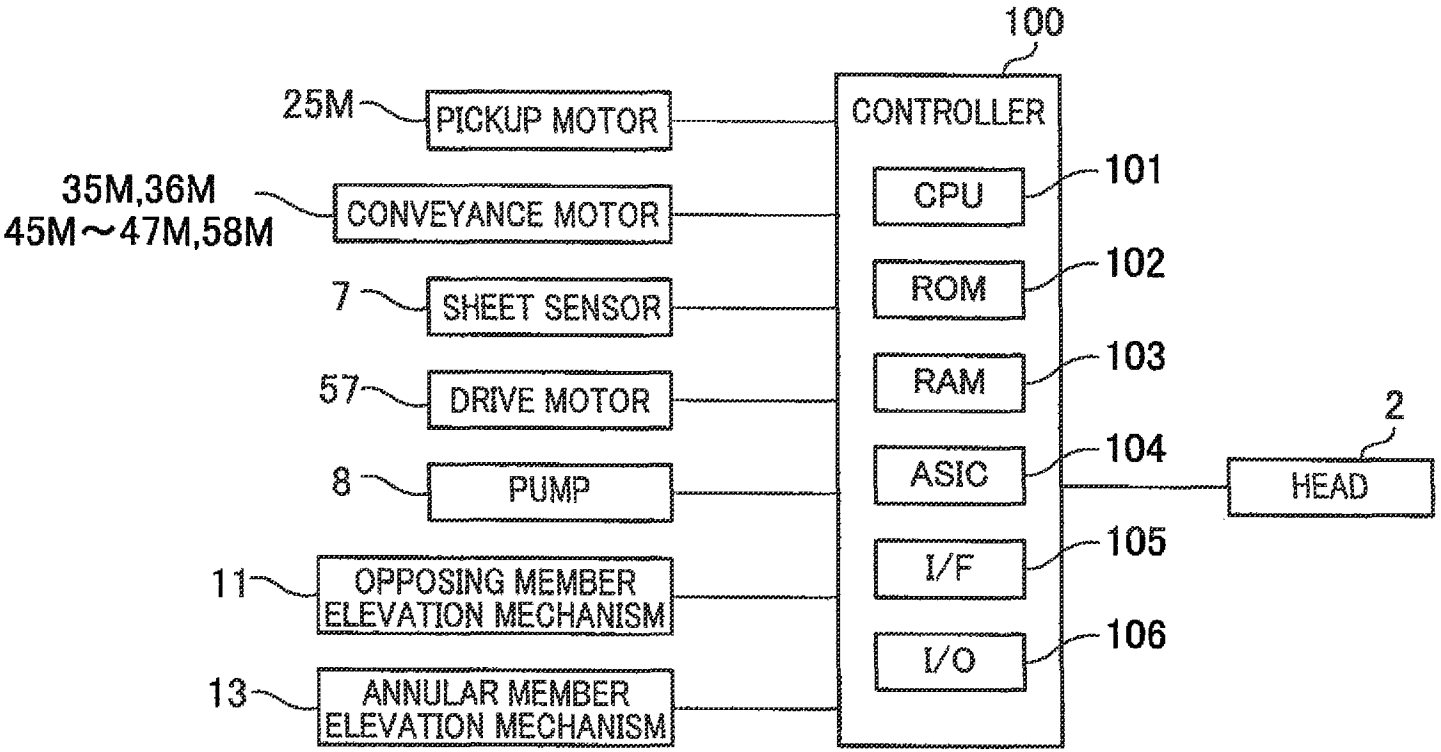
FIG. 8 is a block diagram showing the electric configuration of the printer.

Now, referring to FIG. 8, an electric configuration of the printer 1 will be described.

The controller 100 includes a CPU (Central Processing Unit) 101, a ROM (Read Only Memory) 102, a RAM (Random Access Memory including non-volatile RAM) 103, an ASIC (Application Specific Integrated Circuit) 104, an I/F (Interface) 105, and an I/O (Input/Output Port) 106. The ROM 102 stores programs executed by the CPU 101, various types of fixed data, or the like. The RAM 103 temporarily stores data required for executing a program. The ASIC 104 conducts operations such as rewriting and reordering of image data (e.g., signal processing and image processing). The ITE 105 exchanges data with an external apparatus. The I/O 106 conducts input/output of detection signals to/from sensors.

The controller 100 is connected to the pickup motor 25M, the conveyance motors 35M, 36M, 45M to 47M, and 58M, the drive motor 57, the sheet sensor 7, the pump 8, the opposing member elevation mechanism 11, the annular member elevation mechanism 13, and the control substrate of the head 2.

Now, the recording operation will be described. Upon receiving a recording command, the controller 100 controls the parts so that the recording operation is conducted.

Before the conveyance of a sheet P starts, the controller 100 controls the moving mechanism 53 so as to move the platen 51 from the retracting position to the opposing position, when the platen 51 is at the retracting position. This control is not conducted when the platen 51 is at the opposing position before the start of the conveyance of the sheet P. Thereafter, the controller 100 controls the motors so as to drive the pickup roller 25 and the roller pairs 35, 36, 45 to 47, and 58. The sheet P sent out from the sheet feeding tray 24 is guided by the upstream guide unit 30 to the surface of the platen 51.

When the platen 51 is at the opposing position, the upstream ends of the ribs 64 are positioned on the same level as the upper surfaces 33*c* or lower than the upper surfaces 33*c*. The upstream ends of the ribs 74 are positioned on the same level as the upper surfaces 64*a* and 65*a* or lower than the upper surfaces 64*a* and 65*a*. The upstream ends of the ribs 41*b* are positioned on the same level as the upper surfaces 74*a* or lower than the upper surfaces 74*a*. With the above structure, a projecting level difference is hardly formed between the upstream guide 33 and the upstream support member 61, between the upstream support member 61 and the downstream support member 71, and between the downstream support member 71 and the downstream guide 41. As a result, jamming of the sheet P is suppressed when the sheet P is conveyed while being supported by the upstream guide 33 and the platen 51.

Each rib 64 is positioned, with respect to the main scanning direction, between (i) the midway between the corresponding two ribs 33*b* adjacent to each other and (ii) one of the two ribs 33*b*. Therefore, even if a sheet P is conveyed while being warped with a part of the leading end side of the sheet P positioned lower than the upper surfaces 33*e*, the leading end of the sheet P is less likely to contact any of the upstream ends of the ribs 64. If a part of the leading end side of a sheet P is warped in any of the spaces between the ribs 33*b*, the leading end of the sheet P is positioned lowest at the midway between the corresponding ribs 33*b*. Therefore, if each rib 64 is positioned at the midway between the corresponding two ribs 33*b* adjacent to each other, the leading end of the sheet P is more likely to be caught at the upstream end of the rib 64, possibly causing jamming of the sheet P. On the other hand, in this embodiment, each rib 64 is positioned, not at the midway between the corresponding two ribs 33*b* adjacent to each other, but between the midway and one of the two ribs 33*b*, that is, each rib 64 is positioned closer to the one of the two ribs 33*b*. With this, the leading end of the sheet P is less likely to be caught at the upstream end of the rib 64, and thereby jamming of a sheet P is suppressed.

Further, even if a sheet P is conveyed while being warped with a part of the leading end side of the sheet P positioned lower than the upper surfaces 33*c*, the leading end of the sheet P is guided along the corresponding slope 64*a*1. This suppresses jamming of the sheet P. Furthermore, even if the sheet P is conveyed while being warped with a part of the leading end side of the sheet P positioned lower than the upper surfaces 74*a*, the leading end of the sheet P is guided along the corresponding slope 41*c*1. This suppresses jamming of the sheet P. In addition, since the slopes 65*a*1 are formed on the ribs 65, the upstream ends of the ribs 65 are positioned lower than the upper surfaces 64*a*. Therefore, even if a sheet P is conveyed with a part of the sheet P being warped in a space between two ribs 64 adjacent to each other in the main scanning direction without the plate 63*a* interposed therebetween, the leading end of the sheet P is guided along the corresponding slope 65*a*1. As a result, jamming of the sheet P is suppressed.

When a sheet P passes through the position immediately below the head 2 in the conveyance direction D, the controller 100 controls the head 2 so that the ink is ejected through the ejection openings and a desired image is formed on the sheet P. Thereafter, the sheet P is guided by the downstream guide unit 40 and discharged to the sheet discharge section 4 from the upper part of the housing 1*a*.

Now, the maintenance operation will be described. Upon receiving a maintenance instruction (e.g., a purging signal or a capping signal), the controller 100 controls the parts so that the maintenance operation is conducted.

Upon receiving the purging signal, the controller 100 controls the moving mechanism 53 to move the platen 51 to the retracting position as shown in FIG. 9A. Thereafter, as shown in FIG. 9B, the controller 100 controls the opposing member elevation mechanism 11 to move the opposing member 10 from the waiting position to the ink receiving position. Subsequently, the controller 100 controls the pump 8 so as to discharge the ink through all the ejection openings of the head 2. The discharged ink is received by the surface 10*a*. As the ink is received by the surface 10*a*, the housing 1*a* hardly becomes dirty inside.

Subsequently, the controller 100 controls a wiping unit (not illustrated) to wipe the ejection surface 2*a* and the surface 10*a*. This makes it possible to remove the foreign matters remaining on the ejection surface 2*a* and the surface 10*a*. The removed foreign matters are sent to a foreign matter processor (not illustrated). Upon receiving the capping signal, the controller 100 controls the annular member elevation mechanism 13 so that the annular member 12 contacts the surface 10*a* and the recording space is closed and separated from the external space. The capping is conducted in this way, and the drying of the ink in the ejection openings is suppressed. As such, the maintenance operation is completed. Thereafter, upon receiving a recording command, the controller 100 controls the annular member elevation mechanism 13 to return the annular member 12 to the original position (which is shown in FIG. 9A and is a position at which the annular member 12 is not in contact with the opposing member 10). Furthermore, the controller 100 controls the opposing member elevation mechanism 11 and the moving mechanism 53 so as to move the opposing member 10 to the waiting position and to move the platen 51 to the opposing position. Then the recording operation starts.

As described above, in the printer 1 of this embodiment, a projecting level difference at which the leading end of a sheet P might be caught is hardly formed between the upstream guide 33 and the upstream support member 61, and between the downstream support member 71 and the downstream guide 41. With this, jamming of a sheet P is suppressed.

The three rollers 58*b* which are the driven rollers are attached to the upstream support member 61, and this simplifies the structure of a transmission mechanism which transmits the power from the conveyance motor 58M.

The platen 51 includes the upstream support member 61 and the downstream support member 71. The upstream support member 61 and the downstream support member 71 are moved by the moving mechanism 53 in the opposite directions along the sub scanning direction. Thus, the platen 51 is a double-door type platen.

Figure 10:
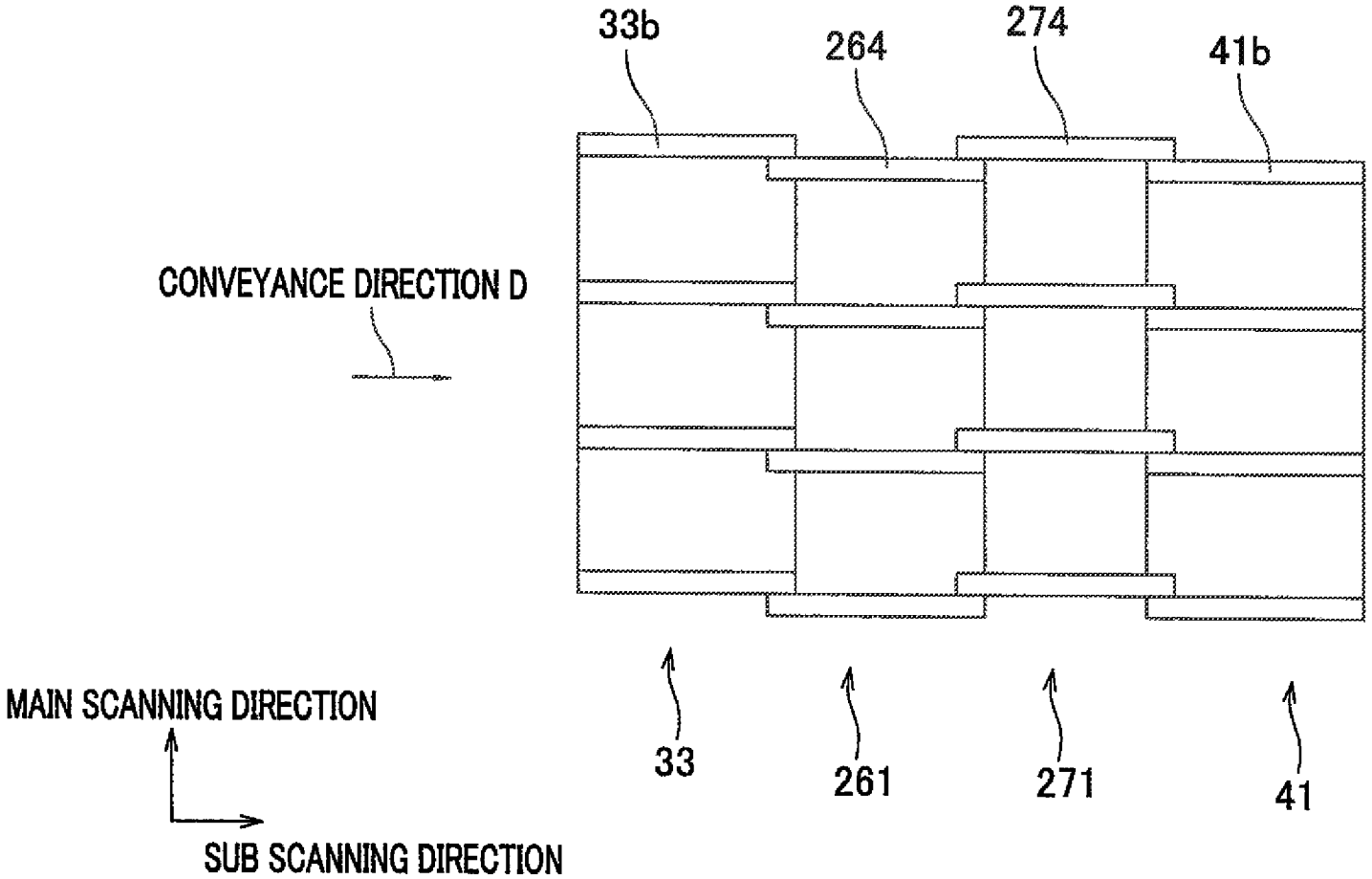
FIG. 10 is a partial plan view of a conveyor unit of a variation.

The upstream second portions do not have to be respectively at the same positions as the downstream second portions with respect to the orthogonal direction. For example, in a variation shown in FIG. 10, the ribs 33*b* are respectively positioned at different positions from the ribs 41*b* with respect to the main scanning direction. Instead, ribs 264 are respectively at the same positions as the ribs 41*b*, and ribs 274 are respectively at the same positions as the ribs 33*b*, with respect to the main scanning direction. Also in the variation shown in FIG. 10, jamming of a sheet P is suppressed similarly to the above-described embodiment. However, in this variation in which the ribs 33*b* are respectively positioned at the different positions from the ribs 41*b* with respect to the main scanning direction, the guide 33 is at a different position from the guide 41 with respect to the main scanning direction, leading to an increase in the length of the conveyor unit in the main scanning direction. On the other hand, in the above-described embodiment, the ribs 33*b* are at the same positions as the ribs 41*b* with respect to the main scanning direction, leading to the downsizing of the conveyor unit 3 in the main scanning direction.

Figure 11:
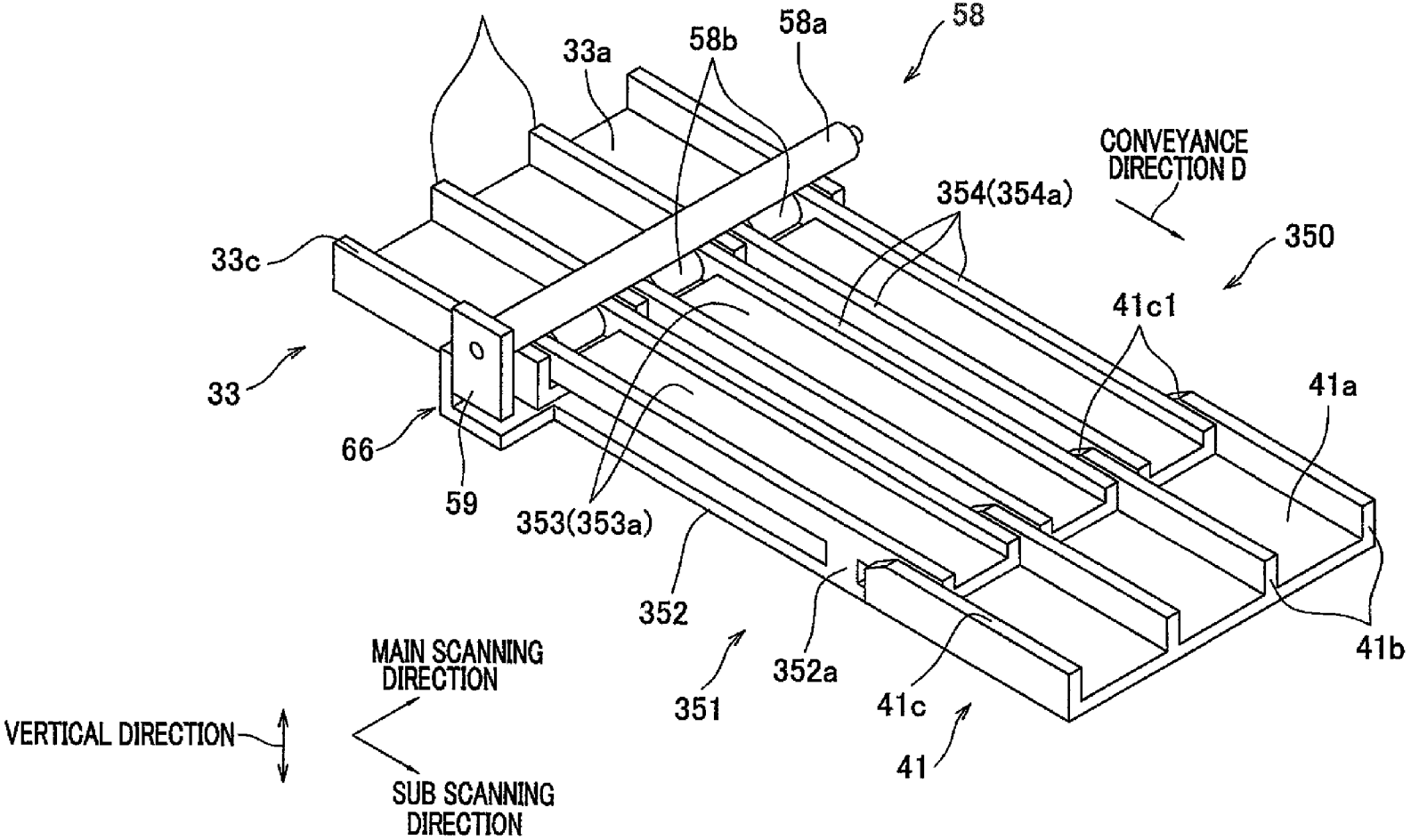
FIG. 11 is a partial oblique perspective view of a support member of a variation, when a platen is at the opposing position.

The support member do not have to include the upstream support member and the downstream support member which move in the opposite directions along the sub scanning direction. A support unit 350 of a variation shown in FIG. 11 includes a platen 351 corresponding to the support member of the present invention. The platen 351 moves toward the upstream direction when moving from the opposing position to the retracting position, and moves toward the downstream direction when moving from the retracting position to the opposing position. The platen 351 includes a base 352 formed by a plate having a rectangular shape in plan view, three plates 353 each extending in the conveyance direction D, and six ribs 354 each extending in the conveyance direction D. The base 352, the three plates 353, and the six ribs 354 are integrally formed. In the variation of FIG. 11, components same as those in the above-described embodiment are given the same reference numerals, and the description of these components will be omitted.

A connector 352*a* is formed between the middle of the base 352 in the conveyance direction D and the downstream end of the base 352. The connector 352*a* protrudes upward from an upper surface of the base 352, and extends in the main scanning direction. The three plates 353 are connected to the base 352 via the connector 352*a*. The three plates 353 are positioned above the base 352 while being spaced apart from the base 352. The three plates 353 are arranged in the main scanning direction apart from one another at regular intervals. Upper surfaces 353*a* of the three plates 353 are positioned on the same level as one another. Gaps for preventing interference between the base 33*a* and the platen 351 and between the base 41*a* and the platen 351 are respectively created at positions which are between the base 352 and the three plates 353 and which sandwich the connector 352*a* in the conveyance direction D.

Each rib 354 has the same structure as that of the rib 64, except that the rib 354 is longer in the sub scanning direction than the rib 64. That is, each rib 354 includes a slope similar to the slope 64*a*1. With this, the upstream ends of the ribs 354 are positioned lower than upper surfaces 354*a* of the ribs 354. Therefore, when the platen 351 is at the opposing position (the position shown in FIG. 11), the upstream ends of the ribs 354 are positioned on the same level as the upper surfaces 33*c* or lower than the upper surfaces 33*c*. Accordingly, a projecting level difference is hardly formed between the upstream guide 33 and the platen 351. As a result, jamming of a sheet P is suppressed when the sheet P is conveyed while being supported by the upstream guide 33. In the variation of FIG. 11, the same features as in the above-described embodiment bring about the same advantageous effects.

In the variation of FIG. 11, a moving mechanism configured to move the platen 351 has a substantially same structure as a component of the moving mechanism 53 which component is configured to move the upstream support member 61. Therefore, the moving mechanism of this variation has a simpler structure than the moving mechanism 53. In addition, while the moving mechanism 53 includes the two drive motors 57, the moving mechanism of this variation includes a single drive motor 57. Thus, the number of the drive motors 57 is smaller than that of the moving mechanism 53 by one. Further, the platen 351 is a single-door type platen, and therefore the travel distance of the platen 351 is longer than the travel distance of the upstream support member 61. Because of this, the moving mechanism of this variation includes a rack longer than the rack 55*a*. In this variation, when the platen 351 is moved upstream in the conveyance direction from the opposing position to take the retracting position, the three rollers 58*b* are positioned at a distance from the roller 58*a*, which distance is larger than the distance between the roller 58*a* and the three rollers 58*b* at the second position of the above-described embodiment. Therefore, in this variation, it is further easier to remove a sheet P jamming between the rollers 58*a* and 58*b* than in the above-described embodiment. In this variation, the ribs 41*b* may be omitted to form the downstream guide 41 by a flat plate. In this case, an upper surface of the flat plate forming the downstream guide 41 is positioned on the same level as the upper surfaces 354*a* or lower than the upper surfaces 354*a*. The ribs 354 and the plates 353 do not overlap, with respect to the conveyance direction D, the flat plate forming the downstream guide 41.

Figure 12:
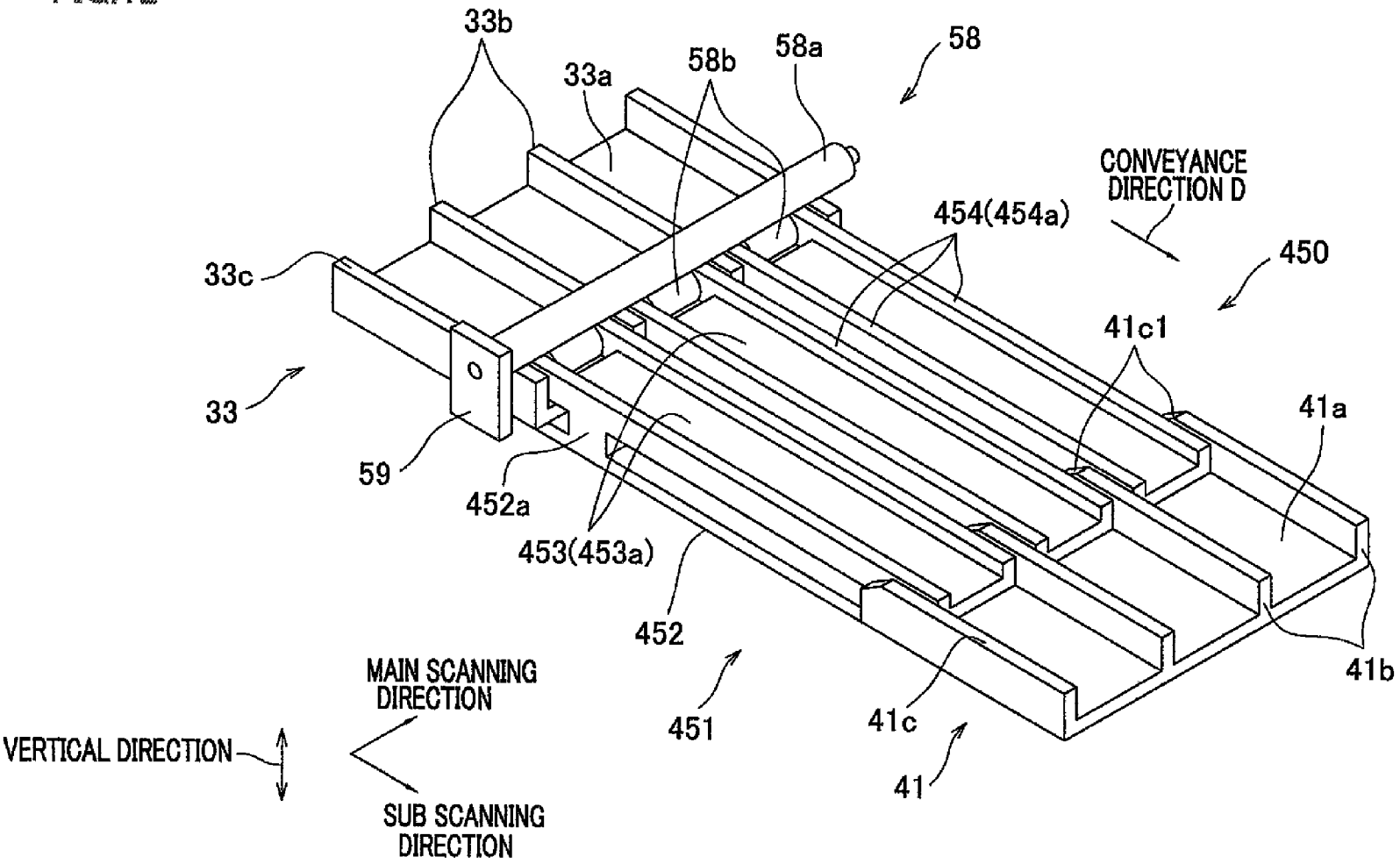
FIG. 12 is a partial oblique perspective view of a support member of another variation, when a platen is at the opposing position.

A support unit 450 of another variation shown in FIG. 12 includes a platen 451 corresponding to the support member of the present invention. The platen 451 is configured to move in the manner opposite to the platen 351: the platen 451 moves toward the downstream direction when moving from the opposing position to the retracting position, while the platen 451 moves toward the upstream direction when moving from the retracting position to the opposing position. The platen 451 includes a base 452 formed by a plate having a rectangular shape in plan view, three plates 453 each extending in the conveyance direction D, and six ribs 454 each extending in the conveyance direction D. The base 452, the three plates 453, and the six ribs 454 are integrally formed. In the variation of FIG. 12, components same as those in the above-described embodiment will be given the same reference numerals, and the description of these components will be omitted. In the variation of FIG. 12, the base 452 is not provided with the contact portion 66.

A connector 452*a* is formed between the middle of the base 452 in the conveyance direction D and the upstream end of the base 452. The connector 452*a* protrudes upward from an upper surface of the base 452, and extends in the main scanning direction. The three plates 453 are connected to the base 452 via the connector 452*a*. The three plates 453 are positioned above the base 452 while being spaced apart from the base 452. The three plates 453 are arranged in the main scanning direction apart from one another at regular intervals. Upper surfaces 453*a* of the three plates 453 are positioned on the same level as one another. Gaps for preventing interference between the base 33*a* and the platen 451 and between the base 41*a* and the platen 451 are respectively created at positions which are between the base 452 and the three plates 453 and which sandwich the connector 452*a* in the conveyance direction D.

Each rib 454 has the same structure as that of the rib 354. That is, each rib 454 includes a slope similar to the slope 64*a*1. With this, the upstream ends of the ribs 454 are positioned lower than upper surfaces 454*a* of the ribs 454. Therefore, when the platen 451 is at the opposing position (the position shown in FIG. 12), the upstream ends of the ribs 454 are positioned on the same level as the upper surfaces 33*c* or lower than the upper surfaces 33*c*. Accordingly, a projecting level deterrence is hardly formed between the upstream guide 33 and the platen 451. As a result, jamming of a sheet P is suppressed when the sheet P is conveyed while being supported by the upstream guide 33. In the variation of FIG. 12, the same features as in the above-described embodiment bring about the same advantageous effects.

In the variation of FIG. 12, a moving mechanism configured to move the platen 451 has a substantially same structure as a component of the moving mechanism 53 which component is configured to move the downstream support member 71. Therefore, the moving mechanism of this variation has a simpler structure than that of the moving mechanism 53. In addition, while the moving mechanism 53 includes the two drive motors 57, the moving mechanism of this variation includes a single drive motor 57. Thus, the number of the drive motors 57 is smaller than that of the moving mechanism 53 by one. Further, the platen 451 is a single-door type platen, and therefore the travel distance of the platen 451 is longer than the travel distance of the downstream support member 71. Because of this, the moving mechanism of this variation includes a rack longer than the rack 55*a*. In this variation, when the platen 451 is moved downstream in the conveyance direction from the opposing position to take the retracting position, the three rollers 58*b* are positioned at a distance from the roller 58*a*, which distance is larger than the distance between the roller 58*a* and the three rollers 58*b* at the second position of the above-described embodiment. Therefore, in this variation, it is further easier to remove a sheet P jamming between the rollers 58*a* and 58*b* than in the above-described embodiment. In this variation, the ribs 33*b* may be omitted to form the upstream guide 33 by a flat plate. In this case, an upper surface of the flat plate forming the upstream guide 33 is positioned on the same level as the upper surfaces 454*a* or higher than the upper surfaces 454*a*. The ribs 454 do not extend further toward the upstream direction than the plates 453. The ribs 454 do not overlap, with respect to the conveyance direction D, the flat plate forming the upstream guide 33.

The slopes 64*a*1 may be omitted when the upper surfaces 64*a*, 354*a*, 454*a*, and the upstream ends of the ribs 64, 354, 454 are positioned on the same level as the upper surfaces 33*c* or lower than the upper surfaces 33*c*. The slopes 41*c*1 may be omitted when the upper surfaces 41*c* and the upstream ends of the ribs 41*b* are positioned on the same level as the upper surfaces 74*a*, 354*a*, 454*a* or lower than the upper surfaces 74*a*, 354*a*, 454*a*. The upper surfaces 64*a*, 354*a*, 454*a* may be positioned higher than the upper surfaces 33*c* when the upstream ends of the ribs 64, 354, 454 are positioned on the same level as the upper surfaces 33*c* or lower than the upper surfaces 33*c* due to the presence of the slopes 64*a*1 formed on the ribs 64, 354, 454. The upper surfaces 41*c* may be positioned higher than the upper surfaces 74*a*, 354*a*, 454*a* when the upstream ends of the ribs 41*b* are positioned on the same level as the upper surfaces 74*a*, 354*a*, 454*a* or lower than the upper surfaces 74*a*, 354*a*, 454*a* due to the presence of the slopes 41*e*1 formed on the ribs 41*b*.

Each rib 64, 354, 454 may be positioned, with respect to the main scanning direction, at the midway between the corresponding two adjacent ribs 33*b*. Each rib 64, 354, 454 may be spaced apart from the corresponding ribs 33*b* in the main scanning direction. The power from the conveyance motor 58M may be transmitted to the rollers 58*b* via the transmission mechanism. That is, the rollers 58*b* may be driving rollers. The rollers 58*b* does not have to be attached to the platen 51, 351, 451. The annular member 12 may be omitted, i.e., only the opposing member 10 may be provided. Further, the maintenance unit may be omitted.

The present invention is applicable to both line-type printers and serial-type printers. The present invention is applicable not only to printers but also any recording apparatus such as facsimile machines and photocopiers. The present invention is further applicable to recording apparatuses ejecting liquid other than ink. The present invention is not limited to inkjet recording apparatuses, and is applicable to laser-type and thermal-type recording apparatuses. Various types of recordable media may be used as the recording medium.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from h spirit and scope of the invention as defined in the following claims.

What is claimed is:

1. A recording apparatus, comprising:

a head including an ejection surface on which a plurality of ejection openings for ejecting liquid are formed;

a conveyor configured to convey a recording medium toward a space which opposes the ejection surface;

a support member configured to support the recording medium in the space;

a moving mechanism configured to move the support member in a conveyance direction in which the recording medium is conveyed by the conveyor to cause the support member to take an opposing position at which the support member opposes the ejection surface and a retracting position at which the support member does not oppose the ejection surface;

an upstream guide positioned upstream of the head in the conveyance direction and configured to support the recording medium; and a downstream guide positioned downstream of the head in the conveyance direction and configured to support the recording medium;

wherein:

the support member includes a plurality of first portions arranged in an orthogonal direction which is orthogonal to the conveyance direction, each of the first portions extending in the conveyance direction and including a support surface for supporting the recording medium;

at least one of the upstream and downstream guides includes a plurality of second portions arranged in the orthogonal direction, each of the second portions extending in the conveyance direction and including a support surface for supporting the recording medium;

at least two of the first portions are positioned between adjacent two second portions of the second portions, the two adjacent second portions being adjacent to each other in the orthogonal direction;

each of the first portions is at a different position from each of the second portions with respect to the orthogonal direction;

each of the first portions overlaps the second portions with respect to the conveyance direction; and with respect to the orthogonal direction, a distance between one of the first portions and one of the second portions adjacent to each other is smaller than a half of a distance between the two adjacent second portions.

2. The recording apparatus according to claim 1;

wherein each of the first portions includes a first slope inclined upward from an upstream end of the first portion in the conveyance direction toward a downstream direction of the conveyance direction.

3. The recording apparatus according to claim 1;

wherein:

each of the first portions includes a first side face being along the conveyance direction;

each of the second portions includes a second side face being along the conveyance direction; and at least a part of each first side face contacts the corresponding second side face when the support member moves between the opposing position and the retracting position.

4. The recording apparatus according to claim 1;

wherein:

the second portions include a plurality of upstream second portions provided to the upstream guide, and a plurality of downstream second portions provided to the downstream guide; and the upstream second portions are respectively at same positions as the downstream second portions with respect to the orthogonal direction.

5. The recording apparatus according to claim 4;

wherein each of the downstream second portions includes a second slope inclined upward from an upstream end of the downstream second portion in the conveyance direction toward a downstream direction of the conveyance direction.

6. The recording apparatus according to claim 4;

wherein:

the moving mechanism is configured to move the support member upstream in the conveyance direction from the opposing position to the retracting position; and each of upstream ends of the first portions in the conveyance direction is positioned on the same level as the upstream second portions or lower than the upstream second portions when the support member is at the opposing position.

7. The recording apparatus according to claim 4;

wherein:

the moving mechanism is configured to move the support member downstream in the conveyance direction from the opposing position to the retracting position; and each of upstream ends of the downstream second portions in the conveyance direction is positioned on the same level as the first portions or lower than the first portions when the support member is at the opposing position.

8. The recording apparatus according to claim 1, further comprising:

a maintenance unit configured to conduct a maintenance operation when the support member is at the retracting position, the maintenance unit being positioned to oppose the ejection surface with the support member interposed between the maintenance unit and the ejection surface when the support member is at the opposing position.

9. The recording apparatus according to claim 8;

wherein the maintenance unit includes a cap which is configured to close the space which opposes the ejection surface.

10. The recording apparatus according to claim 8;

wherein the maintenance unit includes a receiver which is configured to receive the liquid discharged from the ejection openings.

11. The recording apparatus according to claim 1;

wherein, with respect to the orthogonal direction, a distance between two of the first portions which are adjacent to each other with one of the second portions interposed therebetween is smaller than a distance between two of the first portions which are positioned between the two adjacent second potions.

12. A recording apparatus, comprising:

a head including an ejection surface on which a plurality of ejection openings for ejecting liquid are formed;

a conveyor configured to convey a recording medium toward a space which opposes the ejection surface;

a support member configured to support the recording medium in the space;

a moving mechanism configured to move the support member in a conveyance direction in which the recording medium is conveyed by the conveyor to cause the support member to take an opposing position at which the support member opposes the ejection surface and a retracting position at which the support member does not oppose the ejection surface;

an upstream guide positioned upstream of the head in the conveyance direction and configured to support the recording medium; and a downstream guide positioned downstream of the head in the conveyance direction and configured to support the recording medium;

wherein:

the support member includes a plurality of first portions arranged in an orthogonal direction which is orthogonal to the conveyance direction, each of the first portions extending in the conveyance direction and including a support surface for supporting the recording medium;

at least one of the upstream and downstream guides includes a plurality of second portions arranged in the orthogonal direction, each of the second portions extending in the conveyance direction and including a support surface for supporting the recording medium;

at least one of the first portions is positioned between two adjacent second portions of the second portions, the two adjacent second portions being adjacent to each other in the orthogonal direction;

each of the first portions is at a different position from each of the second portions with respect to the orthogonal direction;

each of the first portions overlaps the second portions with respect to the conveyance direction;

the second portions include a plurality of upstream second portions provided to the upstream guide, and a plurality of downstream second portions provided to the downstream guide;

the upstream second portions are respectively at same positions as the downstream second portions with respect to the orthogonal direction;

the support member includes an upstream support member and a downstream support member positioned downstream of the upstream support member in the conveyance direction;

the moving mechanism is configured to move the upstream support member to cause the upstream support member to take a first opposing position at which the upstream support member opposes the ejection surface and a first retracting position at which the upstream support member does not oppose the ejection surface, the moving mechanism configured to move the upstream support member upstream in the conveyance direction from the first opposing position to the first retracting position, and the moving mechanism is configured to move the downstream support member to cause the downstream support member to take a second opposing position at which the downstream support member opposes the ejection surface and a second retracting position at which the downstream support member does not oppose the ejection surface, the moving mechanism configured to move the downstream support member downstream in the conveyance direction from the second opposing position to the second retracting position;

the upstream support member includes a plurality of upstream first portions which are upstream portions of the first portions in the conveyance direction;

the downstream support member includes a plurality of downstream first portions which are downstream portions of the first portions in the conveyance direction;

the upstream first portions are close to the downstream first portions in the conveyance direction when the upstream support member is at the first opposing position and the downstream support member is at the second opposing position; and the upstream first portions are away from the downstream first portions in the conveyance direction when the upstream support member is at the first retracting position and the downstream support member is at the second retracting position.

13. The recording apparatus according to claim 12; wherein:

the downstream first portions are respectively at same positions as the upstream first portions with respect to the orthogonal direction; and at least one of the upstream and downstream support members includes a plurality of third portions each of which is positioned between two downstream first portions of the downstream first portions, the two downstream first portions being adjacent to each other in the orthogonal direction, and between two upstream first portions of the upstream first portions, the two upstream first portions being adjacent to each other in the orthogonal direction, when the upstream support member is at the first opposing position and the downstream support member is at the second opposing position.

14. A recording apparatus, comprising:

a head including an ejection surface on which a plurality of ejection openings for ejecting liquid are formed;

a conveyor configured to convey a recording medium toward a space which opposes the ejection surface;

a support member configured to support the recording medium in the space;

a moving mechanism configured to move the support member in a conveyance direction in which the recording medium is conveyed by the conveyor to cause the support member to take an opposing position at which the support member opposes the ejection surface and a retracting position at which the support member does not oppose the ejection surface;

an upstream guide positioned upstream of the head in the conveyance direction and configured to support the recording medium; and a downstream guide positioned downstream of the head in the conveyance direction and configured to support the recording medium;

wherein:

the support member includes a plurality of first portions arranged in an orthogonal direction which is orthogonal to the conveyance direction, each of the first portions extending in the conveyance direction and including a support surface for supporting the recording medium;

at least one of the upstream and downstream guides includes a plurality of second portions arranged in the orthogonal direction, each of the second portions extending in the conveyance direction and including a support surface for supporting the recording medium;

at least one of the first portions is positioned between two adjacent second portions of the second portions, the two adjacent second portions being adjacent to each other in the orthogonal direction;

each of the first portions is at a different position from each of the second portions with respect to the orthogonal direction;

each of the first portions overlaps the second portions with respect to the conveyance direction;

the conveyor includes a first roller attached to the support member, and a second roller configured to rotate while gripping the recording medium in cooperation with the first roller thereby to convey the recording medium in the conveyance direction;

when the support member is at the opposing position, the first roller is at a first position at which the first roller opposes the second roller and at which the first roller is configured to grip a recording medium in cooperation with the second roller; and when the support member is at the retracting position, the first roller is at a second position at which the first roller is farther away from the second roller than at the first position.

15. The recording apparatus according to claim 14, further comprising:

a drive motor;

wherein:

the second roller is a driving roller configured to be rotated by power from the drive motor; and the first roller is a driven roller configured to be rotated by rotation of the second roller.

16. The recording apparatus according to claim 14;

wherein the first roller is positioned between the two adjacent second portions in the orthogonal direction.

17. The recording apparatus according to claim 14, further comprising:

a roller supporting member which supports the second roller;

wherein the support member includes a contact portion configured to be in contact with the roller supporting member when the support member is at the opposing position, and to be away from the support member when the support member is at the retracting position.

* * * * *